United States Patent [19]

Kajita et al.

[11] Patent Number: 4,840,380

[45] Date of Patent: Jun. 20, 1989

[54] SET OF GOLF CLUBS

[75] Inventors: Ryota Kajita, Matsudo; Hiroshi Esaki, Yokohama; Hirato Shimazaki, Tokyo, all of Japan

[73] Assignee: Bridgestone Corporation, Tokyo, Japan

[21] Appl. No.: 211,152

[22] Filed: Jun. 22, 1988

Related U.S. Application Data

[63] Continuation of Ser. No. 813,454, Dec. 26, 1985, abandoned.

[30] Foreign Application Priority Data

Dec. 25, 1984 [JP] Japan ..... 59-277156
May 31, 1985 [JP] Japan ..... 66-118391

[51] Int. Cl.[4] ..... A63B 53/04

[52] U.S. Cl. ..... 273/77 A; 273/80 A; 273/169

[58] Field of Search ..... 273/77 A, 167 A, 169, 273/170, 171, 172, 167 F, 77 R

[56] References Cited

U.S. PATENT DOCUMENTS 1,642,462 9/1927 Reach ..... 273/77 A
1,945,844 2/1934 Young ..... 273/167 A
3,984,103 10/1976 Nix ..... 273/77 A
4,645,207 2/1987 Teramoto et al. ..... 273/77 A

*Primary Examiner*—George J. Marlo
*Attorney, Agent, or Firm*—Sughrue, Mion, Zinn, Macpeak and Seas

[57] ABSTRACT

A continuous golf club set comprising plural clubs set in the order of club number from a longer driving distance is disclosed. In this set, the club length and the sole width are decreased and the loft and lie are increased in the order of club number. The club length is decreased by 15–30 mm and the sole width decreased by 0–15 mm for each club. The loft is increased by 3°–5° and the lie by 0°–2° in club number order. The set comprises both irons and woods. At least one club of the set has its center of gravity located along a line perpendicular to the club striking face thereof at an inward distance of at least 15 mm therefrom. At least one club of the set has its center of gravity located along a line perpendicular to the club striking face thereof at an inward distance therefrom of between 10 mm and less than 15 mm. At least one club of the set has its gravity located along a line perpendicular to the club striking face thereof at an inward distance of less than 10 mm therefrom.

5 Claims, 9 Drawing Sheets

ZG
ZG
C
INVENTION
O=Distribution Points For PRIOR ART
Depth of Center of Gravity ZG (mm)
35
30
25
20
15
10
5
0
W1
W3
W4
W5
I3
I4
I5
I6
I7
I8
I9
PW
SW
C1
C2
C3
C4
C5
C6
C7
C8
C9
C10
C11
Club No.

SET OF GOLF CLUBS

This is a continuation of Ser. No. 06/813,454, filed on Dec. 26, 1985.

BACKGROUND OF THE INVENTION

1. Field of the Invention

This invention relates to a novel and continuous set of golf clubs set in accordance with the driving distance.

2. Related Art Statement

In 'The Rules of Golf', there is a requirement that the player shall start a stipulated round of golf with not more than fourteen clubs. The clubs are numbered, woods and irons each having their own consecutive number sequence. In this connection, professional and low handicap players generally use a set comprising a combination of 2 to 3 woods having a loft of not more than 23°, 10 to 11 irons having a loft of not less than 24° and a putter. Average player frequently use a set comprising a combination of 4 to 5 woods, 7 to 9 irons and a putter. Among these clubs, the woods are used for shots requiring a long driving distance, and irons are used for shots requiring a direction stability. Further, it is desirable that the driving distance will be reduced in an orderly way from a wood driver toward a pitching wedge in the conventional golf club set.

The driving distance was actually measured with respect to each of 13 golf clubs being, for example, a combination of No. 1, No. 3, No. 4 and No. 5 woods, Nos. 3 to 9 irons, pitching wedge and sand wedge. As a result, the driving distance of the golfball gradually and smoothly reduces from the wood driver for professional players or the like capable of driving the golfball over a distance of not less than 200 m using the wood driver. For average players having a driving power of less than 200 m by the driver, however, a great stepwise difference in the driving distance between No. 5 wood and No. 3 iron exists. This is illustrated in a graph of FIG. 1. Therefore, a need exists to have the driving distance smoothly changed in accordance with the use of a number of golf clubs without causing the above stepwise difference even in their use by average players.

Further, it is known that an inertia moment Iy around a longitudinal axis passing through the center of gravity of the clubhead affects the size of a so-called "sweet area" in the clubhead for enhancing the directional stability of the golfball. In the conventional golf club set, the inertia moment on the y-axis is not considered to gradually increase in accordance with the reduction of the driving distance. This is shown by a curve A in FIG. 2 because the design concept of the wood is entirely different from that of the iron.

SUMMARY OF THE INVENTION

It is, therefore, an object of the invention to provide a set of golf clubs based on a novel design concept which smoothly reduces the driving distance and increases the directional stability as the number of the golf club becomes large even in use by average players.

According to the invention, there is the provision of a continuous golf club set comprising plural clubs in the order of club number from a longer driving distance, and satisfying the following requirements:

(a) a club length is decreased at a given length in said club number order;

(b) each of loft and lie of a clubhead is increased at a substantially given angle in said club number order; and (c) a sole width of a clubhead is decreased at a substantially given width in said club number order.

In a preferred embodiment of the invention, an inertia moment around a longitudinal axis passing through a center of gravity of a clubhead is gradually increased in at least smaller numbered clubs having a loft of not more than 23° as the driving distance becomes shorter.

DESCRIPTION OF THE PREFERRED EMBODIMENTS

According to the invention, the continuous golf club set is developed based on the new concept different from the traditional concept of woods and irons, the set comprises plural clubs, particularly eleven clubs in the order of club number starting from a longer driving distance, whose club number will be represented by C1–C11 hereinafter. When the golf club set according to the invention is used by the average player, the driving distance of each club gradually decreases from club No. C1 toward club No. C11 without producing a large stepwise difference between the adjoining clubs and the inertia moment Iy gradually increases to enhance the direction stability as the driving distance becomes shorter.

Moreover, the club number in the golf club set according to the invention has substantially the following relationship to that of the conventional golf club set:

C1 . . . No. 1 wood (W1)
C2 . . . No. 3 wood (W3)
C3 . . . No. 5 wood (W5)
C4 . . . No. 3 iron (I3)
C5 . . . No. 4 iron (I4)
C6 . . . No. 5 iron (I5)
C7 . . . No. 6 iron (I6)
C8 . . . No. 7 iron (I7)
C9 . . . No. 8 iron (I8)
C10 . . . No. 9 iron (I9)
C11 . . . pitching wedge (PW)

Figure 11:
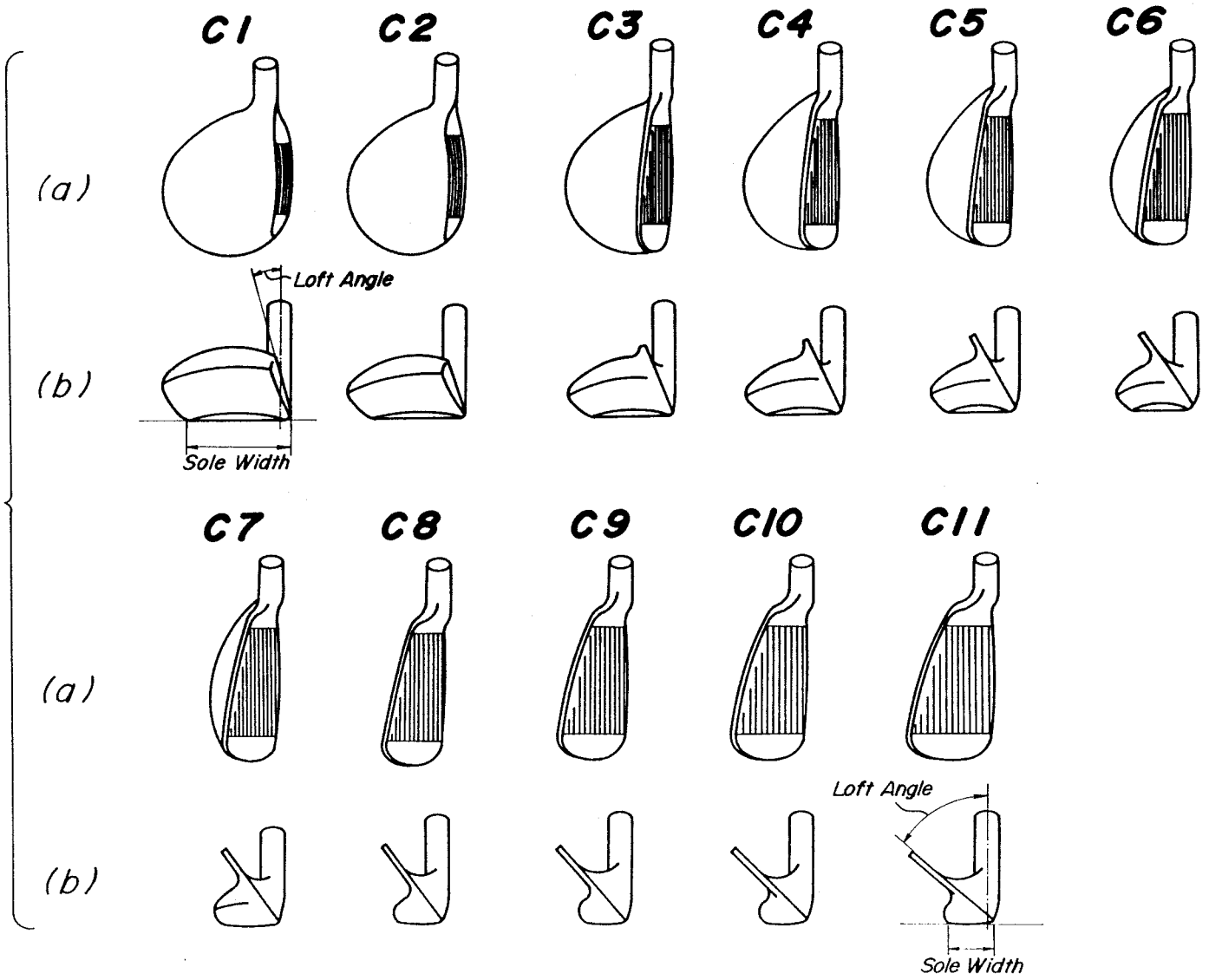
FIGS. 11 and 12 illustrate clubheads and club parameters defining a set of clubs in accordance with this invention.
Figure 12:
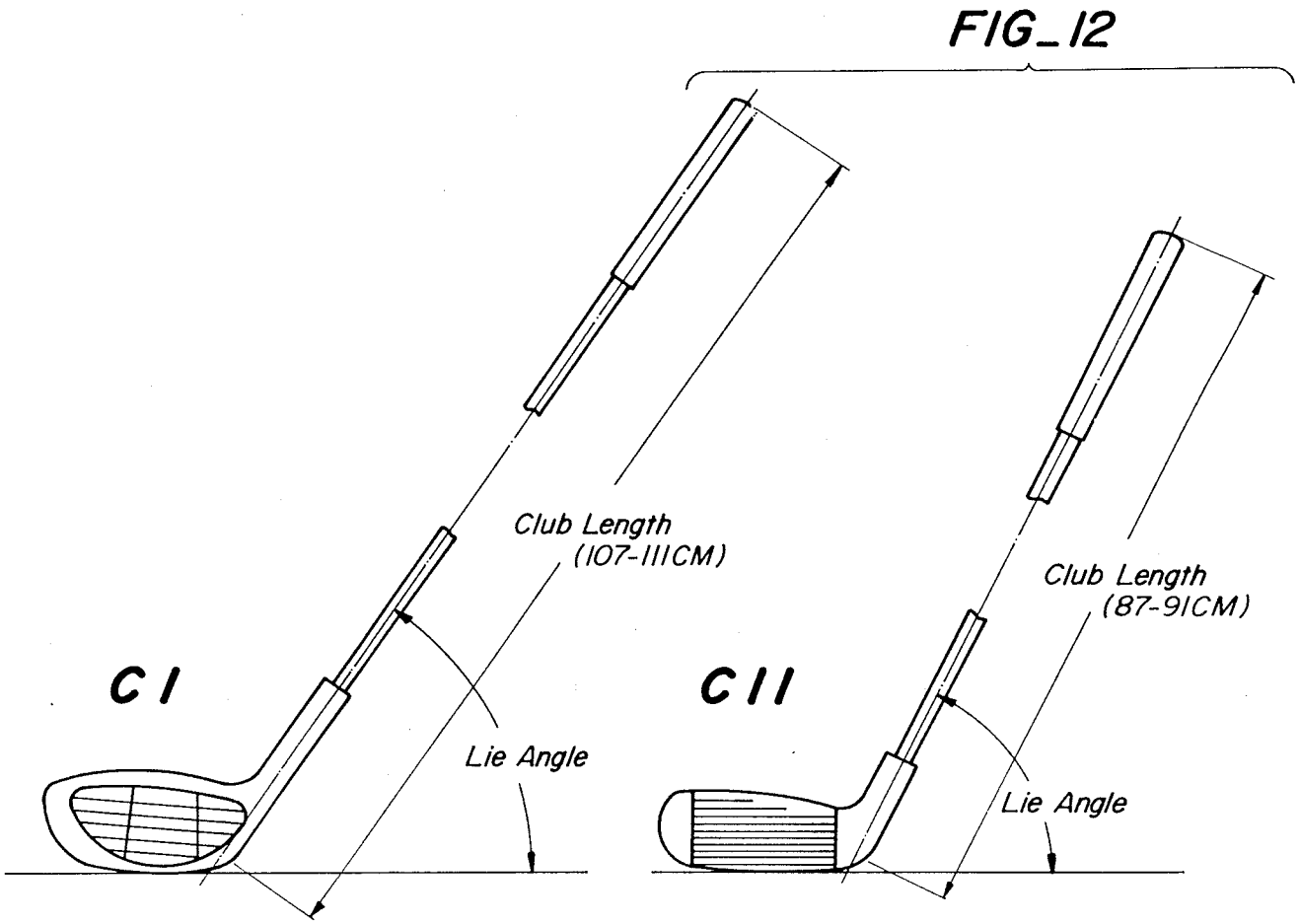

A set of clubheads in accordance with this invention is illustrated in FIG. 11. FIGS. 11 and 12 illustrate club length, lie angle, loft angle, and sole width. Those terms as used herein are conventional in the art as illustrated in these two figures.

Figure 3:
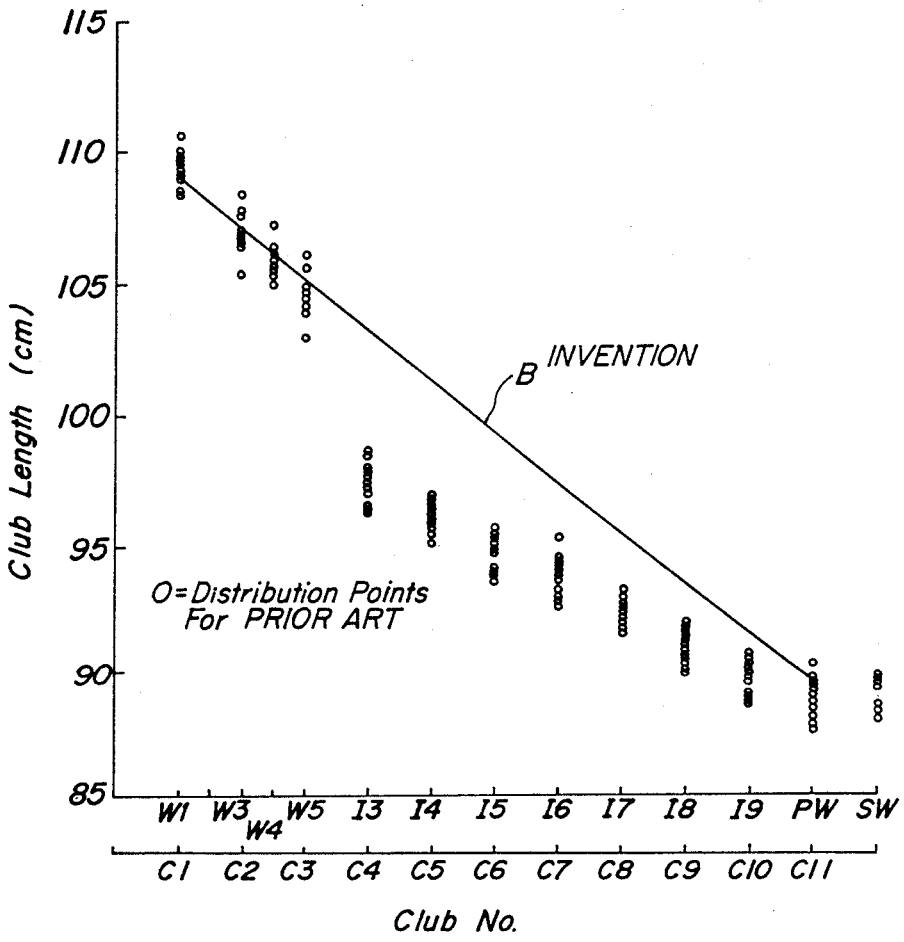
FIG. 3 is a graph showing the club length in the golf club sets according to the invention and the prior art.

In the continuous set according to the invention, the club length changes in accordance with a relation shown by a straight line B in FIG. 3, wherein an abscissa is a club number, for example, C1, C2 . . . in the set according to the invention and W1, W2 . . . in the conventional set. In FIG. 3, a mark (O) shows the club length in the conventional club sets. According to the invention, the club length of each club is set as follows:

C1 . . . 107–111 cm
C2 . . . 105–109 cm
C3 . . . 103–107 cm
C4 . . . 101–105 cm
C5 . . . 99–103 cm
C6 . . . 97–101 cm
C7 . . . 95–99 cm
C8 . . . 93–97 cm
C9 . . . 91–95 cm
C10 . . . 89–93 cm
C11 . . . 87–91 cm

That is, each of the clubs constituting the continuous set according to the invention is within a given present range following the straight line B of FIG. 3.

Further, it is preferable that the club length is decreased at a rate of 15–30 mm in the club number order, i.e., in the direction from club No. C1 to club No. C11. Although there is a difference in the length rate between individual players, such a rate is about 50 mm at maximum. For instance, when the decreasing rate of the club length between the adjoining clubs from club No. C1 to club No. C11 is about 15 mm, the continuous set comprises 12 clubs, while when it is 30 mm, the continuous set comprises 5 to 6 clubs.

Further, the lie (defined between the club shaft and the sole of the clubhead) is increased at an angle of 0°–1° when the decreasing rate of the club length from club No. C1 to club No. C11 is 15 mm and at an angle of 1°–2° when the decreasing rate is 30 mm, respectively.

Figure 4:
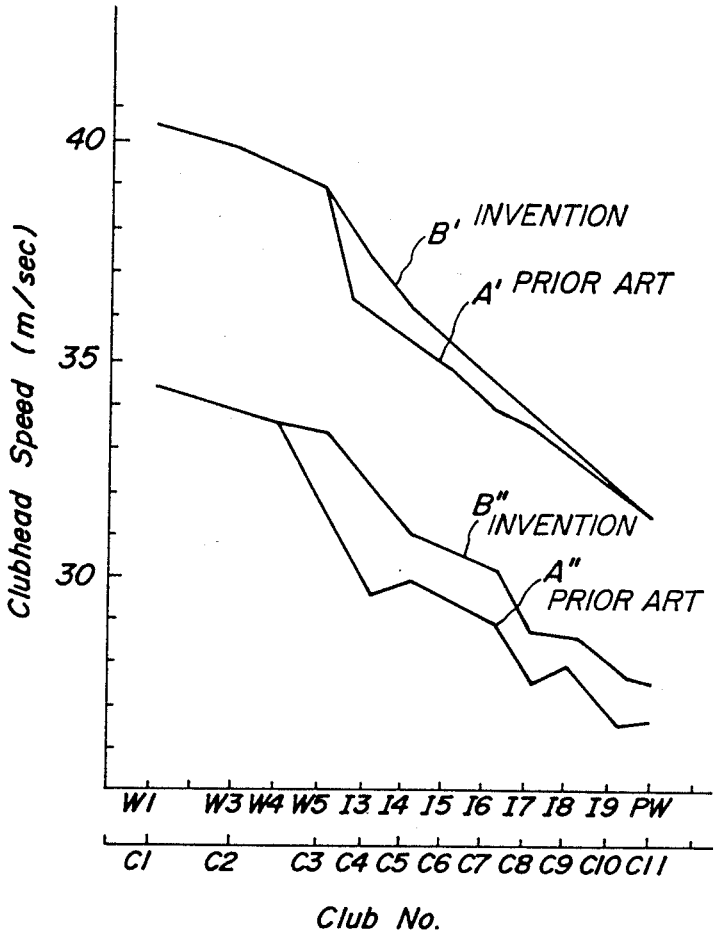
FIG. 4 is a graph showing the clubhead speed measured in the golf club sets according to the invention and the prior art.

In the continuous set wherein the club length of each club is regulated as described above, therefore, the clubhead speed in the swinging by the professional player is increased as shown by a curve B′ in FIG. 4 as compared with that in the conventional set (curve A′). Even in the average player, the increase of the clubhead speed in the continuous set according to the invention (curve B″) becomes remarkable as compared with that in the conventional set (curve A″). As apparent from the curves B′ and B″ of FIG. 4, the stepwise difference in the clubhead speed between C3 and C4 corresponding to the conventional W5 and I3 is fairly improved. Since such an increase of the clubhead speed is reflected in an increase of the driving distance, the aspect of minimizing the stepwise difference in the clubhead speed between the clubs is considered to result in having the driving distances of the clubs smoothly linked with each other.

However, in average players having no power capable of attaining a clubhead speed for utilizing the loft range of the conventional long iron, when the club length is merely decreased at a given rate from club No. C1 toward club No. C11, clubhead speed can smoothly be reduced with the increase of the club number. However, the golfball cannot be lofted upward in a certain club number and consequently there is a stepwise difference in driving distance. Although it is known to increase the club loft for lofting the flight of the golfball, the increase of club loft generally results in the lowering of the driving distance. Therefore, according to the invention, the loft of each of the clubs is only increased at a given angle of 3°–5° from club No. C1 to club No. C11 for eliminating the stepwise difference in driving distance between the clubs. However, a technique for raising the golfball by spin is applied to each club. That is, the inventors have examined how to increase spin in the iron by utilizing an effect as in the conventional wood. They found that it is effective to increase a sole width in the shape of the clubhead from club No. C1 to club No. C11 for increasing the spin of the ball. In this way, the center of gravity of the clubhead becomes deeper as the sole width of the clubhead is increased, whereby the increase of spin by the club is attained without changing the loft range of this club.

Figure 5:
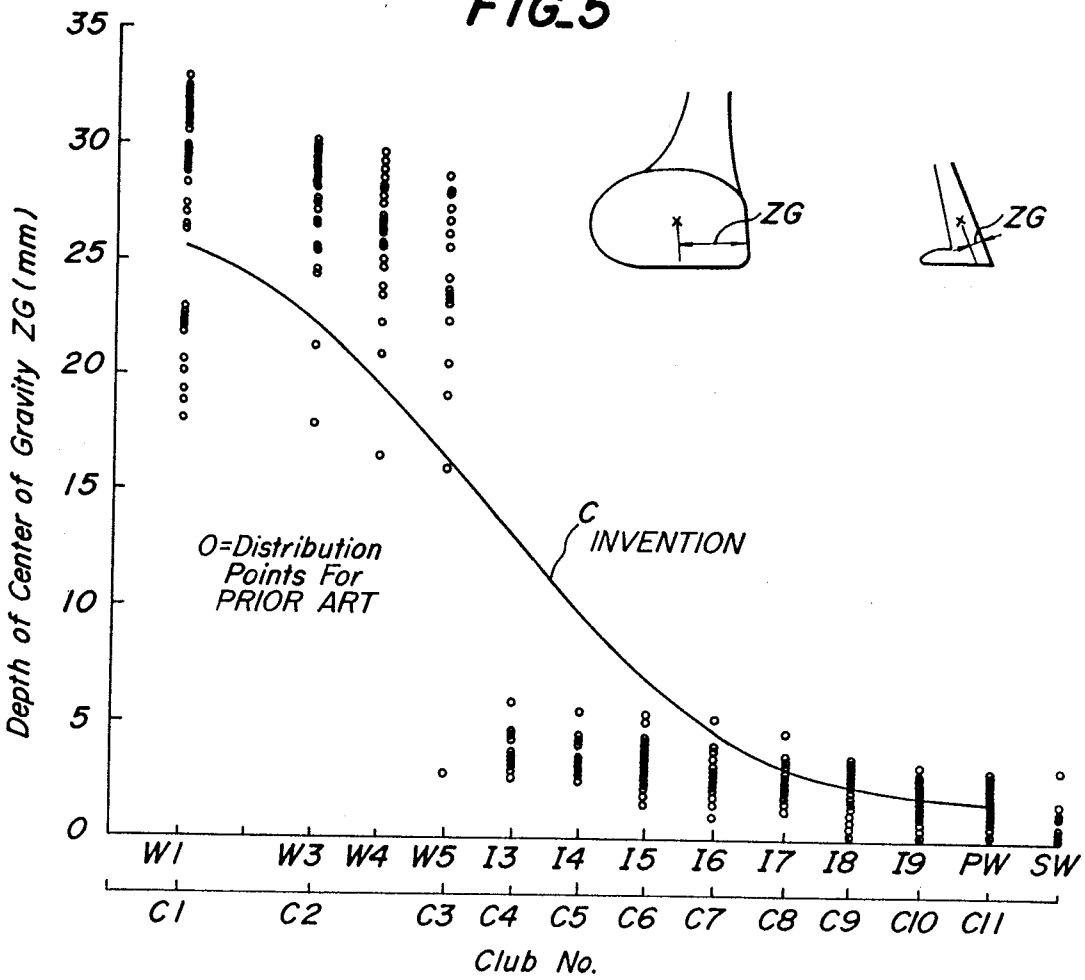
FIG. 5 is a graph showing the center of gravity measured in the golf club sets according to the invention and the prior art.

In the continuous golf club set according to the invention, the depth of center of gravity (ZG) in each club is shown by a curve C in FIG. 5. Moreover, the curve C shows an average value of ZG in each club. In FIG. 5, a mark (O) shows a distribution of the depth of center of gravity in the conventional golf club sets. As apparent from the curve C, therefore, the sole widths of the clubheads are changed to smoothly connect to each other from C1 to C11. In this case, the sole width of the clubhead is decreased at a substantially given rate of 0–15 mm from club No. C1 to club No. C11.

Figure 6:
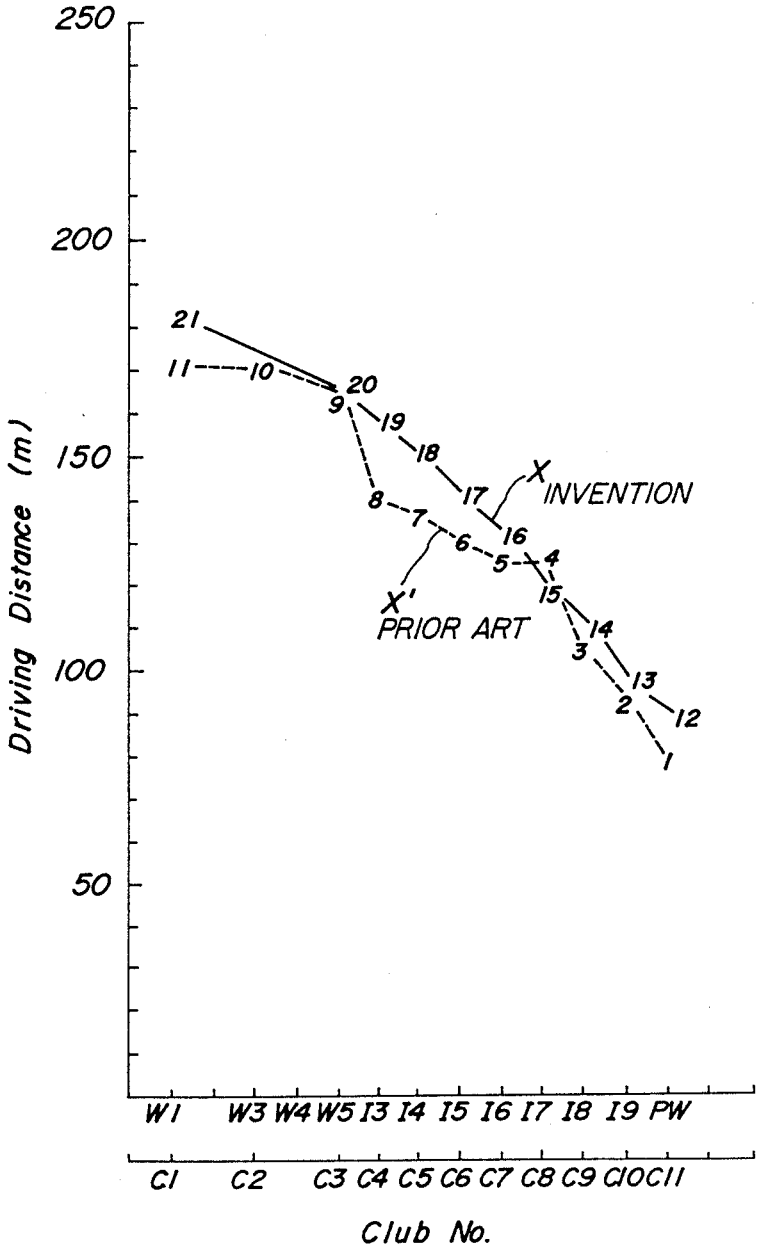
FIGS. 6 and 7 are graphs showing results actually played by average players in the golf club sets according to the invention and the prior art.
Figure 7:
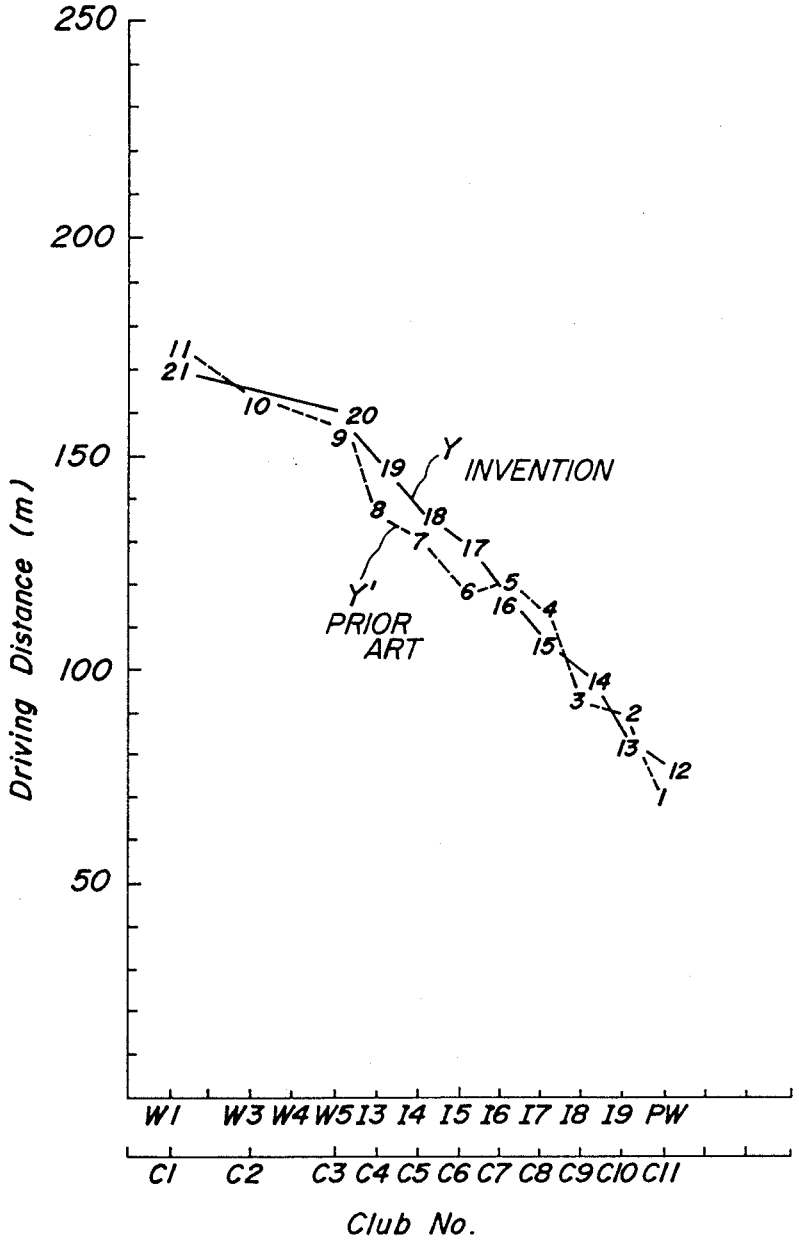

Then, two average players actually hit golfballs with the continuous set of the aforementioned structure according to the invention and the conventional golf club set to obtain results as shown in FIGS. 6 and 7, wherein curves X and Y show the data using the continuous set according to the invention and curves X′ and Y′ show the data using the conventional set. As apparent from the curves X and Y of FIGS. 6 and 7, the driving distances of the clubs smoothly link with each other in the continuous set according to the invention.

Figure 1:
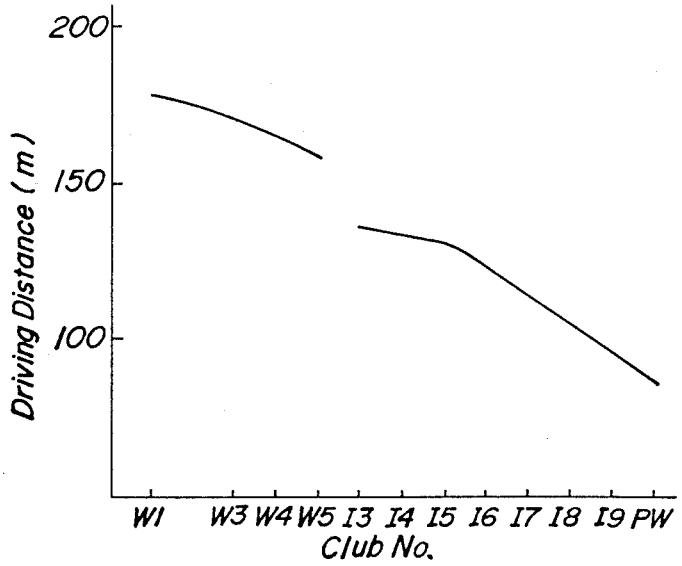
FIG. 1 PRIOR ART
FIG. 1 is a graph showing results measured on the driving distance in the conventional golf club set.
Figure 2:
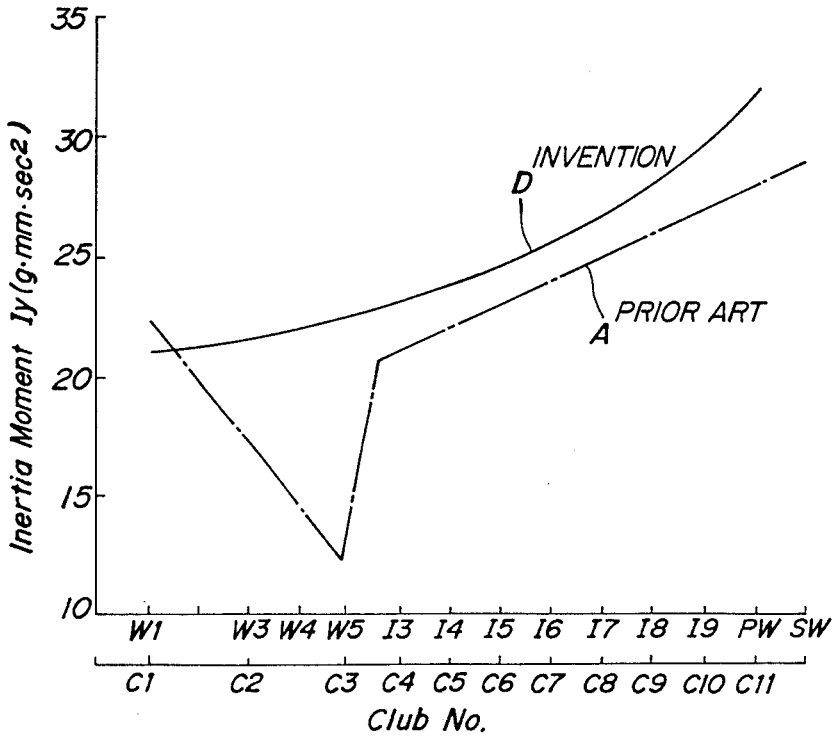
FIG. 2 is a graph showing comparison results measured on the inertia moment between the conventional golf club set and the golf club set according to the invention.

As shown by a curve D in FIG. 2, the continuous set according to the invention is preferably constructed so that the inertia moment Iy becomes gradually larger from club No. C1 to club Nos. C11 as the driving distance of the club becomes gradually shorter.

Figure 8:
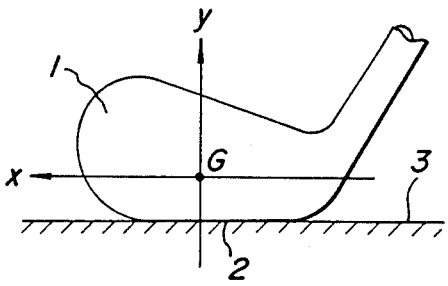
FIG. 8 is a schematical view illustrating the inertia moment.

As shown in FIG. 8, when a clubhead 1 is placed on a plane 3 so as to contact a sole 2 of the clubhead 1 with the plane 3, assuming that a straight line passing through a center of gravity G in the clubhead 1 and in parallel to the plane 3 is the x-axis and a straight line passing through the center of gravity G and perpendicular to the x-axis is the y-axis, inertia moments around the x-axis and y-axis are represented by Ix and Iy, respectively. In particular, it has been confirmed that the inertia moment Iy strongly affects initial velocity, side spin and striking direction of the golfball when striking by the club at right and left directions of its sweet spot. Further, it has been confirmed that the inertia moment Iy affects the driving resistance and right and left direction stabilities because the initial velocity of the golfball has an influence on the driving distance and the striking direction and side spin thereof have an influence on right and left direction stabilities. Also, the inertia moment Iy affects the sweet area of the clubhead, i.e., the increase of the inertia moment Iy enlarges the sweet area in the right and left directions. On the other hand, the increase of the inertia moment Ix enlarges the sweet area in up and down directions.

As an embodiment of the continuous set according to the invention, all of clubheads 1 as shown in the following Table 1 were made of a hollow metal body.

Figure 9:
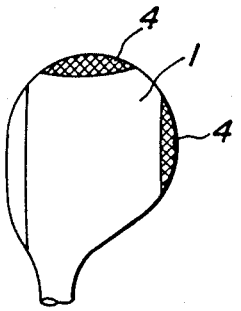
FIGS. 9 and 10 are schematical views of the clubhead of the golf club according to the invention, respectively.
Figure 10:
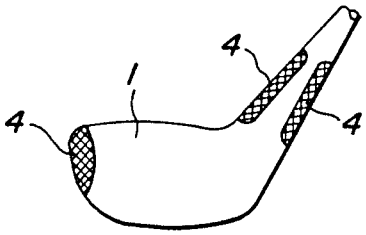

Moreover, a surplus weight was added to the weight of the clubhead by thickening portions of the clubhead 1 indicated by numeral 4 in FIG. 9 or 10.

TABLE 1

| Club No. | C1 | C2 | C3 | C5 | C6 | C8 | C9 | C11 |
|---|---|---|---|---|---|---|---|---|
| Loft (°) | 12 | 18 | 20.8 | 27.1 | 30 | 38 | 42 | 51 |
| Weight of clubhead (g) | 185 | 191 | 197 | 213 | 226 | 240 | 254 | 273 |
| Iy (g · mm sec$^2$) | 19.5 | 19.9 | 20.2 | 22.2 | 23.0 | 27.2 | 29.2 | 30.7 |
| Club length (cm) | 109 | 107 | 105 | 101 | 99 | 95 | 93 | 89 |

(Thickness Face: 2.8 m/m, Others: 1.1 m/m)

In Table 1, the sole width of the clubhead was gradually decreased at a rate of 0–15 mm from the club No. C1 to club No. C11. As seen from Table 1, the inertia moment Iy becomes larger as the driving distance gradually decreases.

In the embodiment of Table 1, each of all clubheads 1 is made of a hollow metal body, but clubs having a loft of not more than 23°, which correspond to the conventional woods, may be made of persimmon or synthetic resin or composite material. The clubhead 1 made of the synthetic resin or composite material may be hollow in the interior or be filled with a filler. Moreover, the clubs having a loft of not less than 24°, which correspond to the conventional irons, may also be made of a material other than metal.

As mentioned above, according to the invention, the club length in plural clubs constituting the continuous set is decreased at a given length in the order of club number from a longer driving distance, so that the driving distances of the clubs smoothly link with each other in accordance with the change of the club length without causing the stepwise difference in the driving distance between the clubs and consequently the professional players and low handicap players can select an optimum club from the continuous set in accordance with circumstances. Further, the loft and lie of the clubhead are increased at given angles and the sole width thereof is decreased at a substantially given rate from club No. C1 to club No. C11, so that the stepwise difference in the driving distance between the clubs can be made small by the increase of clubhead speed and the spin effect even in the average player. Moreover, the inertia moment around longitudinal axis passing though the center of gravity of the clubhead gradually increases in at least clubs having a loft of not more than 23° as the driving distance gradually decreases, so that the golfball is exactly driven as the club number becomes large. In the conventional iron set, the clubhead is often constructed so as to increase the inertia moment Iy exerting on the size of sweet area of clubhead toward a longer driving distance, so that when such a conventional iron concept is applied to clubs corresponding to at least conventional woods as defined in the invention, a better continuous golf club set can be obtained.

We claim:

1. A continuous golf club set comprising:

at least one club having its center of gravity located along a line perpendicular to the club striking face thereof at an inward distance of at least 15 mm therefrom, at least one club having its center of gravity located along a line perpendicular to the club striking face thereof at an inward distance therefrom of between 10 mm and less than 15 mm, and at least one club having its center of gravity located along a line perpendicular to the club striking face thereof at an inward distance of less than 10 mm therefrom, said continuous set having clubs ordered from a longer to a shorter driving distance with increasing loft and lie angles, said clubs having:

(a) a club length for each club decreased within a range of 15–30 mm in said club order;

(b) for each clubhead, a club loft and lie are increased within a loft angle range of 3°–5° and a lie angle of not more than 2°, in said club order; and (c) for each clubhead a sole width is decreased not more than 15 mm in said club order.

2. The continuous golf set according to claim 1, comprising eleven clubs, three of which are woods, seven of which are irons and one pitching wedge.

3. The continuous golf set according to claim 2, wherein the club length of the longest club in said set is in the range of 107–111 cm and the club length of the shortest club in said set is in the range of 87–91 cm.

4. The continuous golf club set according to claim 1, wherein the clubs in said set have an inertia moment of a clubhead around a longitudinal axis passing through a center of gravity of said clubhead gradually increasing as club length decreases.

5. The continuous golf club set according to claim 4, wherein said inertia moment of clubs gradually increases over said golf club set as club length decreases.

* * * * *